United States Patent [19]

Murai

[11] Patent Number: 4,680,935

[45] Date of Patent: Jul. 21, 1987

[54] CRYOGENIC CONTAINER

[75] Inventor: Takashi Murai, Kobe, Japan

[73] Assignee: Mitsubishi Denki Kabushiki Kaisha, Japan

[21] Appl. No.: 868,438

[22] Filed: May 30, 1986

[30] Foreign Application Priority Data

May 31, 1985 [JP] Japan ..... 60-82739[U]

[51] Int. Cl.[4] ..... F17C 1/00

[52] U.S. Cl. ..... 62/45; 220/420; 220/425

[58] Field of Search ..... 62/45, 54; 220/420, 220/425

[56] References Cited

U.S. PATENT DOCUMENTS

| | | | |
|---|---|---|---|
| 2,195,077 | 3/1940 | Brown | 62/54 |
| 2,643,022 | 6/1953 | Cornell | 62/54 |
| 3,538,714 | 11/1970 | Kling et al. | 62/54 |
| 3,705,498 | 12/1972 | DeHaan | 62/54 |
| 3,938,346 | 2/1976 | Ovchinnikov et al. | 62/54 |
| 4,091,634 | 5/1978 | Shepherd | 62/45 |

*Primary Examiner*—Ronald C. Capossela

*Attorney, Agent, or Firm*—Leydig, Voit & Mayer

[57] ABSTRACT

A cryogenic container having an inner tank for storing cryogen therein, an outer tank for housing the inner tank therein in a thermally insulating relationship, and a pipe connected between the outer and inner tanks for supporting the inner tank relative to the outer tank. The pipe has a heat conducting cross sectional area which is larger at the portion near the outer tank side than at the portion near the inner tank side, thereby reducing the heat conduction through the pipe.

5 Claims, 4 Drawing Figures

CRYOGENIC CONTAINER

BACKGROUND OF THE INVENTION

The present invention relates to a cryogenic container for storing a cryogen.

A conventional container is disclosed in, e.g., a catalogue for the liquefied helium gas container type RS50 made by L'AIR LIQUIDE in France and sold in Japan through TEIKOKU SANSO Co. Ltd. the present name of which has changed to TEISAN Co. Ltd. Such a container, as shown in FIG. 1, has an inner tank 1 for storing a cryogen 4 therein, an outer tank 2 for housing the inner tank 1 therein and a connecting pipe 3 called a neck tube for supporting the weight of the inner tank 1 and cryogen 4 with respect to the outer tank 2. Space 9 formed between the inner and outer tanks 1 and 2 is vacuum. Shields for radiation heat are disposed in this space in some kind of container.

In the container mentioned above, a combination of the inner and outer tanks 1 and 2 forms a vacuum bottle and the low temperature of the inner tank 1 is kept by the vacuum space 9 with respect to the outer tank 2. The cryogen 4 stored within the inner tank 1 can be taken out through the connecting pipe 3 to the outside of the container. The connecting pipe 3 is constituted by a thermal conductor so that the pipe 3 conducts heat from the outer tank 2 at room temperature to the inner tank 1 at a cryogenic temperature. Although the connecting pipe 3 is designed so as to reduce the heat conducting cross sectional area thereof and increase the length of the heat conducting path of the pipe, there are some restrictions in which the pipe must support the weight of the inner tank 1 and cryogen 4 must be disposed in the limited space 9 between the inner and outer tanks 1 and 2. Due to such restrictions, it is difficult for the connecting pipe 3 to sufficiently meet the above-mentioned requirements about heat conducting cross sectional area and length of heat conducting path.

Since the connecting pipe 3 must mechanically support the weight of the inner tank 1 and cryogen 4 with respect to the outer tank 2 and since the heat conduction through the connecting pipe 3 must be limited as much as possible, the wall thickness or the transverse cross sectional area of the connecting pipe 3 has been determined to provide just enough strength to support the weight of the inner tank 2 and cryogen 4. However, while the strength of material generally increases as the temperature of the material lowers and the inner end of the connecting pipe 3 which is at low temperature is stronger than the outer end of the pipe at room temperature, the conventional connecting pipe 3 is made of a tube of a constant diameter and a constant wall thickness without taking into consideration such changes of material strength according to temperture. Therefore, the end of the pipe near the low temperature inner tank has a transverse cross sectional area which is unnecessarily large in relation to its mechanical strength. This unnecessarily large cross sectional area allows excess heat conduction therethrough.

To overcome the problems mentioned above, an object of the present invention is to provide a cryogenic container in which a connecting pipe can withstand the weight of an inner tank and cryogen and in which the heat conduction through the connecting pipe is reduced.

With the above object in view, the present invention resides in a cryogenic container comprising inner tank means for storing a cryogen therein, outer tank means for housing said inner tank means therein in a thermally insulating relationship, and pipe means connected between said outer and inner tank means for connecting said inner tank means to the outside of said outer tank means, said pipe means supporting said inner tank means away from said outer tank means and having a wall thickness which is greater at the portion near the outer tank side than that near the inner tank side.

BRIEF DESCRIPTION OF THE DRAWINGS

The present invention will be now described with reference to the preferred embodiments thereof in conjunction with the drawings in which.

DETAILED DESCRIPTION OF THE PREFERRED EMBODIMENTS

Figure 1:
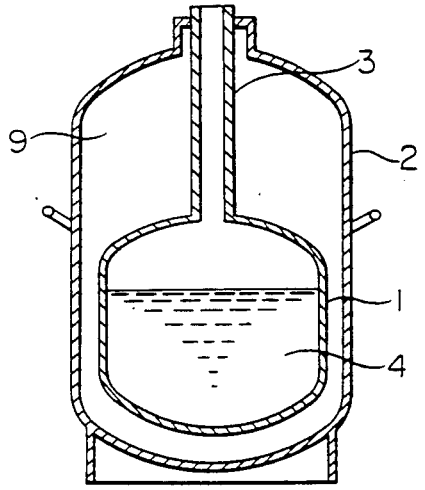
FIG. 1 PRIOR ART
FIG. 1 is a cross-sectional view of a conventional cryogenic container.
Figure 2:
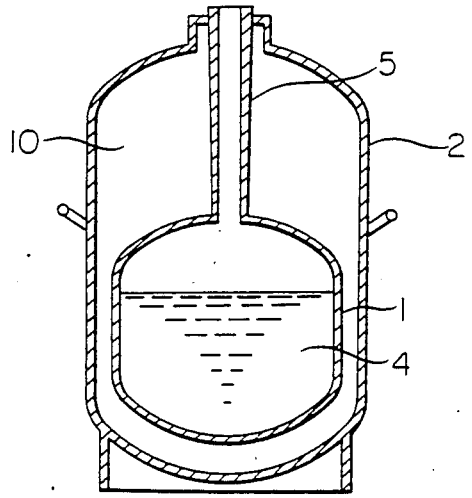
FIGS. 2 to 4 are cross-sectional views of cryogenic containers according to first to third embodiments of the present invention.

In FIG. 2, a cryogenic container according to a first embodiment of the present invention has an inner tank 1 for storing a cryogen 4 therein, an outer tank 2 for housing the inner tank 1 therein in a thermally insulating relationship, and a connecting pipe 5 connected to the inner and outer tanks 1 and 2 and supporting the weight of the inner tank 1 and cryogen 4 with respect to the outer tank 2. Space 10 formed between the inner and outer tanks 1 and 2 is vacuum. The inner tank 1 is thermally insulated from the outer tank 2 by the vacuum space 10. The cryogen 4 stored within the inner tank 1 can be taken out through the connecting pipe 5 to the outside of the container at room temperature. The connecting pipe 5 has a wall thickness gradually decreasing from the portion nearest the outer tank side toward that nearest the inner tank side such that the connecting pipe 5 can withstand the weight of the inner tank 1 and cryogen 4, as described later.

Since the connecting pipe 5 is connected at one end to the inner tank 1 which is at cryogenic temperature and at the other end to the outer tank 2 which is at room temperature, a temperature gradient is generated in the connecting pipe 5 in the longitudinal direction thereof. Also, in general, the strength of material is increased as the temperature thereof is lowered. Utilizing this property, the gradually decreasing thickness of the connecting pipe 5 from the outer tank side toward the inner tank side is set by calculating the strength of the pipe 5 in accordance with the temperature at every minute longitudinal positional change along the length of pipe 5 to obtain the cross sectional area of the pipe required for withstanding the weight of the inner tank 1 and cryogen 4. Therefore, the heat conducting cross sectional area of the connecting pipe 5 is smaller than that of the connecting pipe in the conventional container.

Figure 3:
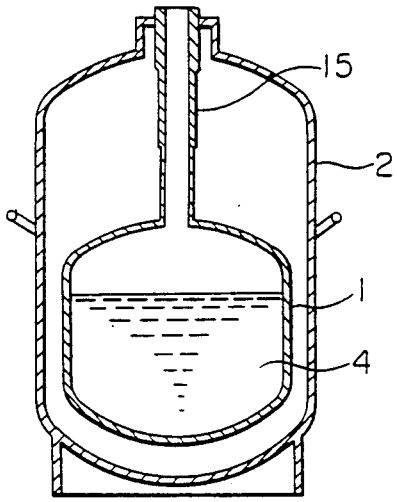

In the first embodiment mentioned above, the strength of the connecting pipe 5 is calculated at every minute longitudinal positional change along the length thereof. However, as in the second embodiment shown in FIG. 3, the cross section of a connecting pipe 15 may be reduced by a plurality of steps disposed in the longitudinal direction of the pipe 15. Such a connecting pipe 15 also has an effect similar to that of the connecting pipe 5 in the first embodiment.

Figure 4:
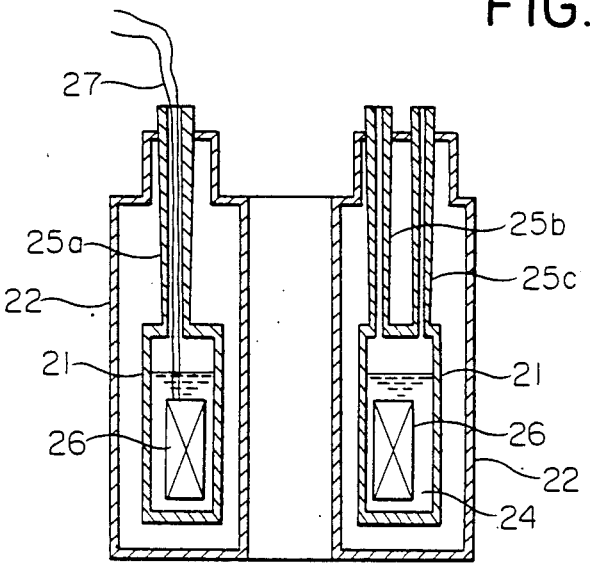

FIG. 4 shows a cryogenic container according to a third embodiment of the present invention. In this container, a superconducting coil 26 is immersed into liquid helium as a cryogen stored within an inner tank 21, and lead wires 27 are electrically connected from the superconducting coil 26 through a connecting pipe 25*a* to the outside of the container at room temperature. One of connecting pipes 25*b* and 25*c*, e.g., the connecting pipe 25*b* is disposed to supply the liquid helium therethrough into the inner tank 21, and the other connecting pipe 25*c* is disposed to discharge the helium gas evaporated by the heating of the superconducting coil 26 within the inner tank 21 to the outside of the container. Each of the connecting pipes 25*a*, 25*b* and 25*c* have a construction similar to that of the connecting pipe 5 in the first embodiment. Such a container also has an effect similar to that in the first embodiment.

As mentioned above, according to the present invention, the cross sectional area of the pipe is small at the portion near the inner tank side which is at cryogenic temperature, so that the quantity of heat that can flow through the connecting pipe into an inner tank for storing a cryogen is reduced, thereby reducing the heat flowing into the entire container.

What is claimed is:

1. A cryogenic container comprising:

an inner tank containing a cryogen;

an outer tank housing said inner tank and having an insulating medium between said inner tank and said outer tank; and a pipe connecting the inside of said inner tank and the outside of said outer tank, said pipe providing the main support of the weight of said inner tank and cryogen contained therein;

the cryogen within said inner tank generating a temperature gradient in said connecting pipe in the longitudinal direction thereof which provides a progressively increasing strength of material from which said connecting pipe is formed as the temperature of the material lowers from an outer portion near the outer tank to a portion connected to said inner tank;

said pipe having a smaller heat-conducting cross-sectional area at the portion connected to said inner tank than the cross-sectional area at the outer portion to reduce heat conduction along said pipe;

said smaller heat-conducting cross-sectional area of said pipe providing a strength sufficient to support the weight of the inner tank and anything contained therein, including cryogen.

2. A cryogenic container as claimed in claim 1 wherein the heat-conducting cross-sectional area of said pipe is tapered from the portion near said outer tank to the portion connected to said inner tank.

3. A cryogenic container as claimed in claim 1, wherein the heat conducting cross sectional area of said pipe is reduced in steps disposed in the longitudinal direction thereof.

4. A cryogenic container as claimed in claim 1, wherein a superconducting coil is disposed within said inner tank and a lead wire electrically connected to the superconducting coil extends through said pipe.

5. A cryogenic container as claimed in claim 1 wherein said pipe comprises a plurality of pipe portions connected between the inner and outer tank.

* * * * *